US006202675B1

(12) United States Patent
Forte

(10) Patent No.: US 6,202,675 B1
(45) Date of Patent: Mar. 20, 2001

(54) LIFT STATION FLOOD CONTROL SYSTEM

(76) Inventor: Robert A. Forte, 7922 Oakleaf, Elmwood Park, IL (US) 60635

( * ) Notice: Subject to any disclaimer, the term of this patent is extended or adjusted under 35 U.S.C. 154(b) by 0 days.

(21) Appl. No.: 09/294,962

(22) Filed: Apr. 20, 1999

Related U.S. Application Data

(60) Provisional application No. 60/085,860, filed on May 18, 1998.

(51) Int. Cl.[7] ..... E02D 29/14
(52) U.S. Cl. ..... 137/371; 137/363; 52/20
(58) Field of Search ..... 137/363, 371; 417/40, 63; 52/20, 21

(56) References Cited

U.S. PATENT DOCUMENTS

| | | | | |
|---|---|---|---|---|
| 681,994 | | 9/1901 | Steele . | |
| 1,959,171 | * | 5/1934 | Mayer | 52/20 X |
| 3,070,021 | | 12/1962 | Tutthill . | |
| 3,112,760 | * | 12/1963 | Budd | 137/363 |
| 3,461,803 | | 8/1969 | Stothoff, III et al. . | |
| 3,672,103 | | 6/1972 | Kost . | |
| 3,715,958 | * | 2/1973 | Crawford et al. | 52/21 |
| 3,938,545 | * | 2/1976 | Nagy et al. | 137/363 |
| 4,178,139 | * | 12/1979 | Seppanen et al. | 52/20 X |
| 4,245,664 | | 1/1981 | Johnson . | |
| 4,275,757 | * | 6/1981 | Singer | 137/363 |
| 4,348,158 | | 9/1982 | Wood . | |
| 4,822,213 | | 4/1989 | Grace et al. . | |
| 4,852,609 | | 8/1989 | Schoenauer . | |
| 4,919,343 | | 4/1990 | Van Luik, Jr. et al. . | |
| 4,928,727 | | 5/1990 | Dufresne . | |
| 4,997,312 | | 3/1991 | Regan . | |
| 5,161,911 | | 11/1992 | Regan . | |
| 5,201,600 | * | 4/1993 | Topf, Jr. et al. | 52/20 X |
| 5,299,637 | * | 4/1994 | Skonvall | 52/21 X |
| 5,382,113 | * | 1/1995 | Chilton et al. | 52/20 X |
| 5,553,794 | | 9/1996 | Oliver et al. . | |
| 5,667,362 | | 9/1997 | Murai et al. . | |
| 5,672,050 | | 9/1997 | Webber et al. . | |
| 5,899,024 | * | 5/1999 | Stannard | 52/20 |
| 6,050,050 | * | 4/2000 | Daul et al. | 52/20 X |

OTHER PUBLICATIONS

Tramco Pumpmaster Lift Station advertising sheet, Tramco Pump Co., Chicago, Illinois, 1979.

* cited by examiner

*Primary Examiner*—John Rivell
(74) *Attorney, Agent, or Firm*—Marshall, O'Toole, Gerstein, Murray & Borun

(57) ABSTRACT

A sewage lift station comprises a lawn trim ring set having a top cap and a reducer ring. The top cap is removably fastened to the reducer ring, and the reducer ring is fastened to a flange on the tank of the sewage lift station. The top cap has a recess for holding sod so that the sewage lift station only minimally alters the appearance of a homeowner's lawn. In addition to or instead of the lawn trim ring set, the lift station may comprise a gravity flow pump bypass. The gravity flow pump bypass comprises a pipe having an inlet in the tank, the pipe extending outside of the tank for passing sewer water to the outside of the tank.

10 Claims, 6 Drawing Sheets

LIFT STATION FLOOD CONTROL SYSTEM

This application claims the benefit of U.S. Provisional Application No. 60/085,860, filed May 18, 1998.

BACKGROUND OF THE INVENTION

1. The Field of the Invention

The present invention is directed generally to a sewage lift station. More particularly, the present invention is directed to a lawn trim ring set for sealing a sewage lift station.

2. Background of Related Art

Because lift stations are normally located in a homeowner's front lawn, it is desired to cover them as much as possible so that they are not unsightly, and yet the lift stations must be somewhat viewable and there must be provided ready access to the interior of the tank for maintenance purposes. Typical tanks have covers which are either entirely exposed on the front lawn and are therefore unsightly, or which are completely buried under the grass, making it not only difficult to locate the cover and remove the grass for maintenance purposes, but also requiring extra effort and expense to rebury the cover. Thus, there is a need for a lift station having a readily accessible tank interior and having a cover which can be easily located but which, for aesthetic purposes, is minimally exposed.

A pump in a sewage lift station may fail for any of a number of reasons such as a power failure. In a conventional sewage lift station, a pump failure may lead to the tank becoming filled with sewage that may rise into the basement of a homeowner. There is a need for a backup system to release sewer water from the tank in the event of a pump failure. A charged sewer line leads from the city sewer into a homeowner's home during heavy rains.

SUMMARY OF THE INVENTION

The aforementioned disadvantages of prior art sewage lift stations are overcome using apparatus in accordance with the present invention. In one embodiment, a lawn trim ring set of the present invention comprises a reducer ring having a flange for connection to a tank and a sleeve extending upwardly from the flange. A top cap having a bottom and an upright wall extending from the bottom is removably fastened to the reducer ring sleeve. With the tank connected to the reducer ring, and the reducer ring removably connected to the top cap, exterior water or debris is prevented from entering the tank. The upright wall and bottom of the top cap define a recess for holding soil and grass atop of the lift station when the lift station has been fully installed. The top cap can be easily removed to perform maintenance on the interior of the tank with only minimal interference with the lawn of a homeowner.

The top cap may be bolted to the reducer ring. Alternatively, the top cap may be attached to an interior surface of the reducer ring sleeve by a slip fit. The reducer ring may comprise an internal sealing flange extending inwardly from an interior surface of the sleeve for sealing the reducer ring to the top cap. The top cap can comprise a flange extending radially outwardly from a top portion of the wall. The top cap can comprise holes for drainage.

In another embodiment of the present invention, a gravity flow pump bypass is provided to pass sewer water from the interior of the tank to the exterior of the tank in the event of a pump failure. The gravity flow pump bypass comprises a pipe having an inlet located in the tank, the inlet being positioned higher than the sewer inlet into the tank, higher than the pump, and at a level lower than the basement floor of a home to which the lift station is associated.

A sewage lift station in accordance with the present invention may comprise either one or both of the above-described lawn trim ring set and gravity flow pump bypass.

DETAILED DESCRIPTION OF THE INVENTION

Figure 1:
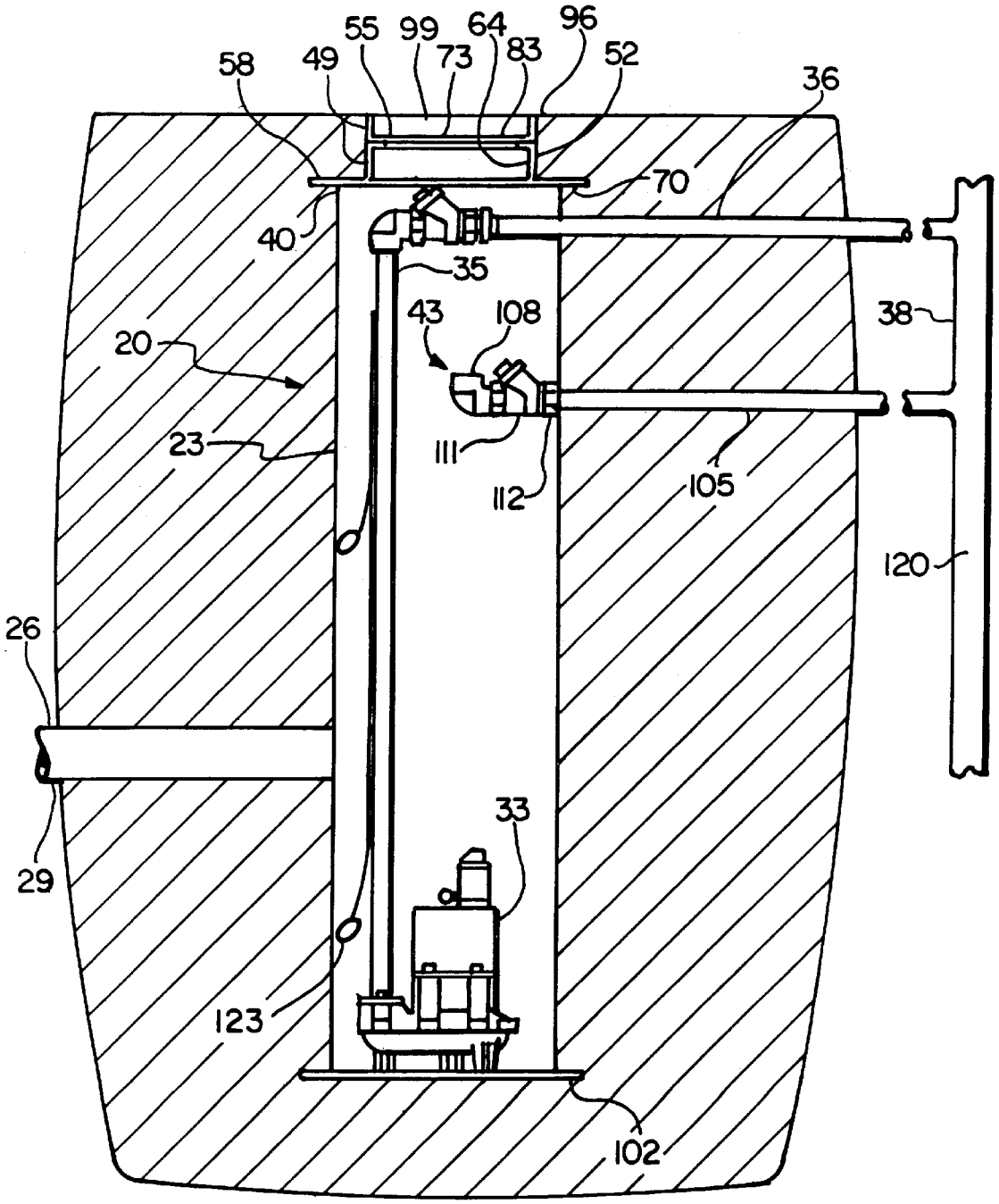
FIG. 1 is a side elevational view, partially broken away, of a sewage lift station in accordance with the present invention.
Figure 10:
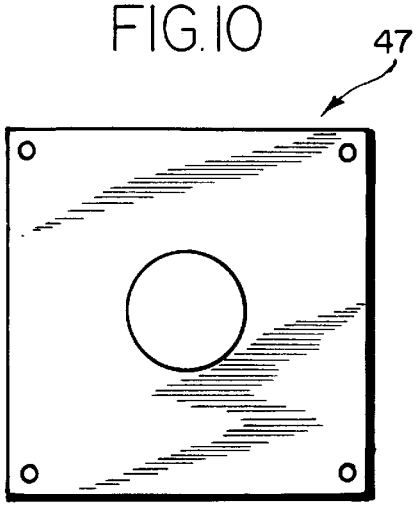
FIG. 10 is a side elevational view of a fiberglass inlet fitting in accordance with the present invention.
Figure 11:
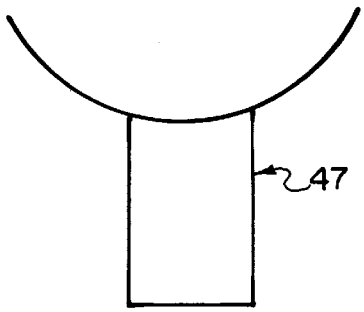
FIG. 11 is a plan view of the inlet fitting of FIG. 10.

Referring initially to FIG. 1, a sewage lift station, designated generally at 20, comprises a fiberglass tank 23 or basin, which may be one-piece, insertable in-line with the sewer line 26 in the ground. A sewer line inlet 29 runs into the tank 23, and an ejector pump 33 is located in the tank 23. A pump discharge line 35 extends upwardly from the ejector pump 33. An outlet 36 near a tank top portion 40 is in fluid communication with the pump discharge line 35 and discharges into a pipe 38 that leads to the main sewer line system (not shown). A gravity flow pump bypass 43 is disposed in the tank 23 and is in communication with the pipe 38. The sewer line inlet 29 can enter the tank 23 through a 6" fiberglass inlet fitting 47 (FIGS. 10 and 11), a cast iron fitting, or any other suitable fitting.

Figure 2:
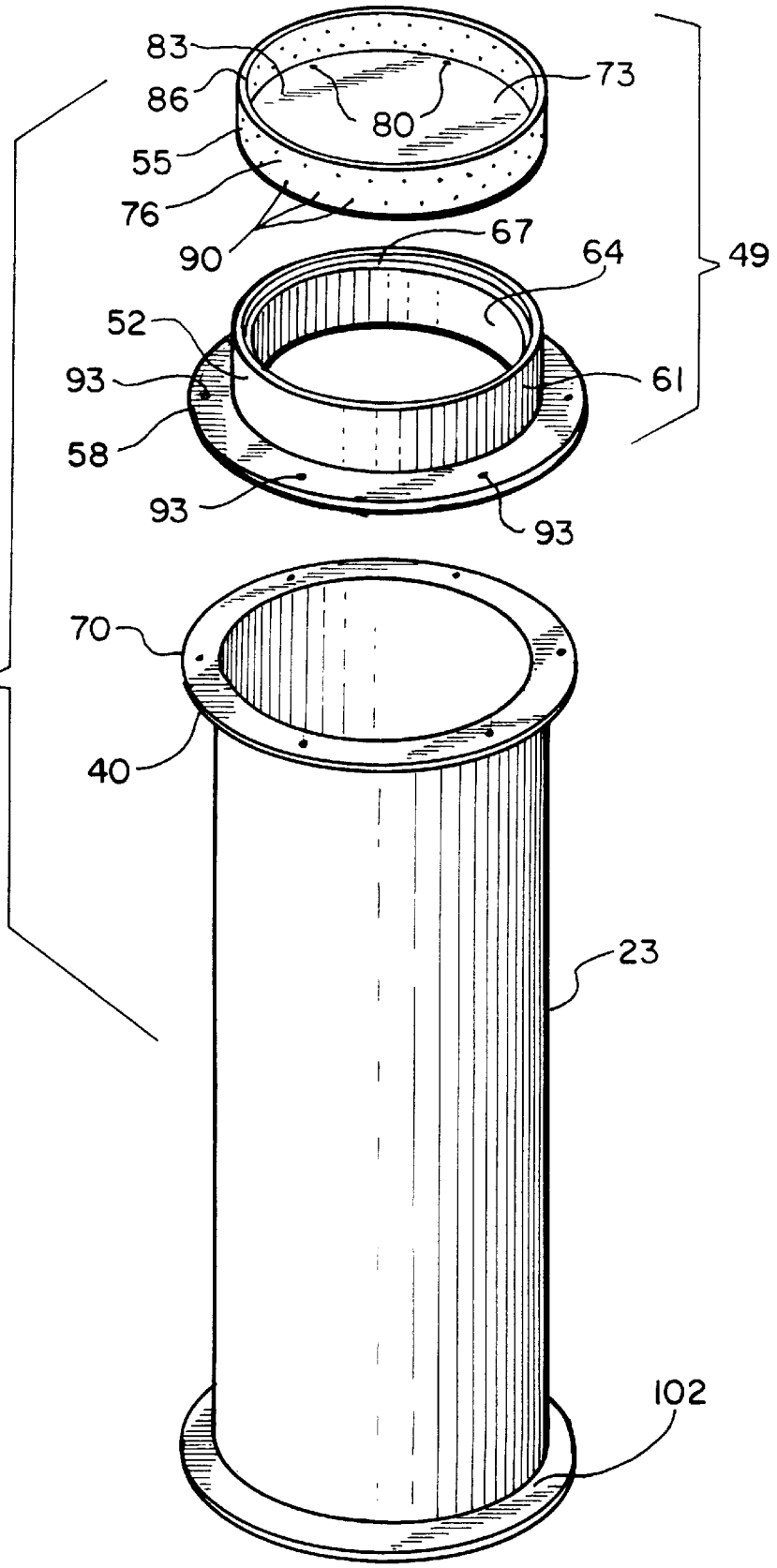
FIG. 2 is an exploded perspective of a bolting flange and lawn trim ring set in accordance with the present invention shown without fasteners or gaskets.
Figure 3:
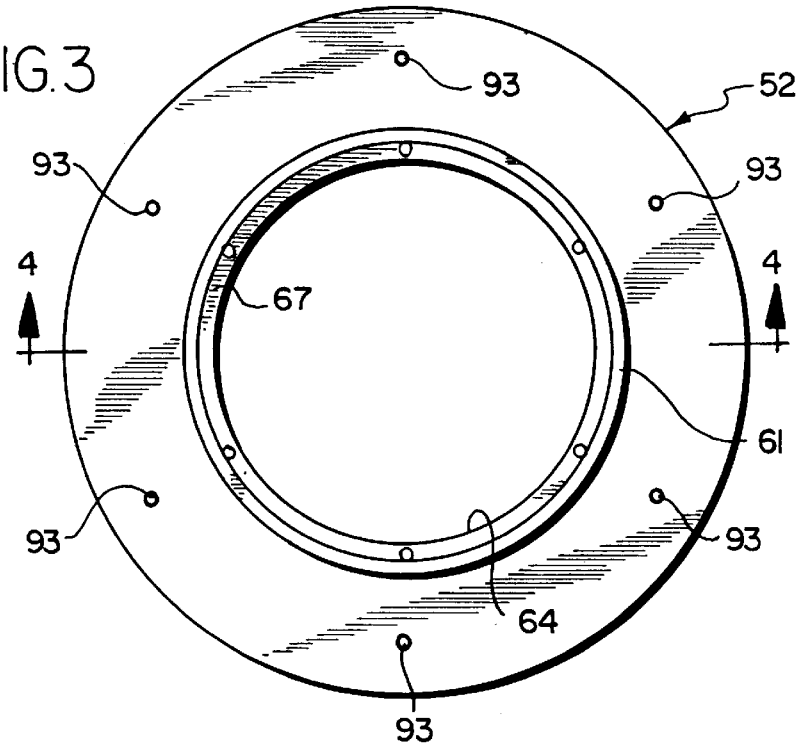
FIG. 3 is a plan view of the reducer ring of FIG. 2.
Figure 4:
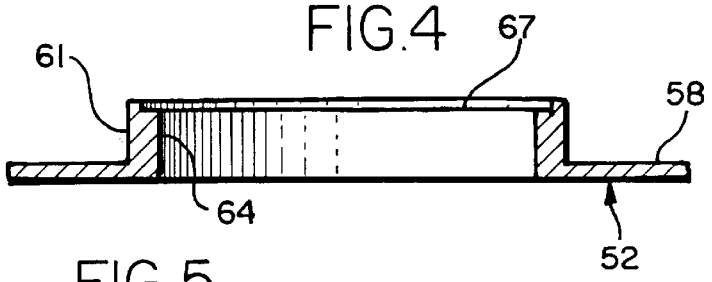
FIG. 4 is a sectional view of the reducer ring of FIG. 3 taken through line 4—4.

Referring also to FIG. 2, the top portion 40 of the tank 23 is sealed by a lawn trim ring set 49 which includes a reducer ring 52 and a top cap 55. Referring to FIGS. 2–4, the reducer ring 52 has a flange 58 for sealing to the tank top portion 40, a sleeve 61 extending upwardly from the flange 58, and a central opening 64 defined by the sleeve 61 for access to the tank interior. The outer diameters of the reducer ring 52 and the top cap 55 may be the same, however, the reducer ring sleeve 61 has a recessed inner ledge 67 for reinforcement and for receiving fasteners (not shown). Thus, the reducer ring 52 has a smaller inner diameter than the top cap 55. The reducer ring flange 58 seals onto a flange 70 at the tank top portion 40, as discussed further below.

Figure 5:
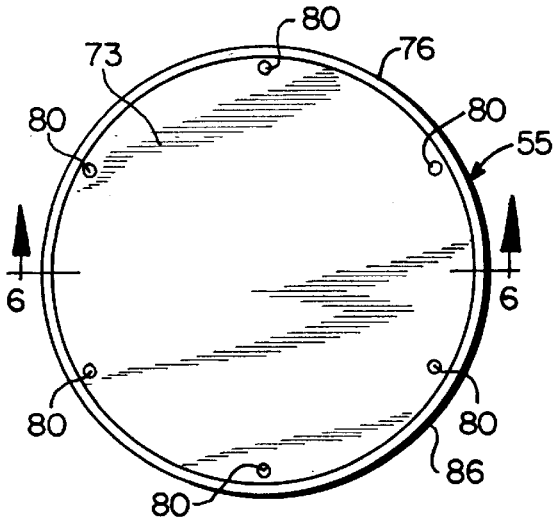
FIG. 5 is a plan view of the top cap of FIG. 2.
Figure 6:
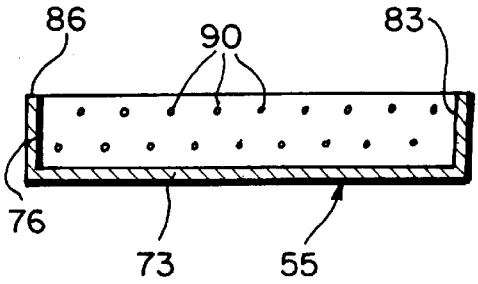
FIG. 6 is a sectional view of the top cap of FIG. 5 taken through line 6—6.

Referring to FIGS. 5 and 6, the top cap 55 has a bottom plate 73 and an upright wall 76 extending therefrom. The top cap 55 is fastened to the reducer ring sleeve 61 by any suitable fasteners such as four ¼"×20 by 2" long hex head bolts that pass through holes 80 in the bottom plate 73 of the top cap 55 and engage the inner ledge 67 of the reducer ring sleeve 61.

The upright wall 76 of the top cap 55 defines a recess 83 for containing soil and grass. After the lawn trim ring 49 set is sealed to the tank 23, the bottom plate 73 will be covered with soil and grass. Thus, the only part of the lift station 20 that is visible from a homeowner's lawn is a top surface 86 of the upright wall 76, and even that may be obscured from view by blades of grass adjacent the top cap 55 because the top surface 86 is substantially even with ground level, as seen in FIG. 1, and, therefore, grass or other vegetation extending above ground level may obscure the top surface 86. The upright wall 76 has relief holes 90 for drainage. When adding sod to the recess 83, limestone powder may be placed on the bottom plate 73 to prevent the sod from getting a fungus.

The top cap upright wall 76 and the reducer ring sleeve 61 may be about 3.5" high. The reducer ring flange 58 may be fastened to the bolting flange 70 of the tank 23 by any suitable means such as by four ¼"×20 stainless steel hex head bolts. Holes 93 in the reducer ring flange 58 and tank flange 70 may have expandable rubber and stainless steel inserts for strengthening the connection. A gasket (not shown) may be placed between the reducer ring flange 58 and tank flange 70 to provide extra sealing. A suitable gasket is a 1" wide, ⅛" thick rubberized sponge, double-faced tape gasket. Silicone may be deposited between the reducer ring flange 58 and tank flange 70 to provide a watertight seal.

The top cap 55 may be fastened to the ledge 61 at the top of the reducer ring sleeve 61 using four ¼"×20 stainless steel hex head bolts. A gasket, such as the gasket described above for placement between the reducer ring flange 58 and tank flange 70, may be placed between the top cap 55 and the reducer ring 52. Once fastened to the reducer ring 52, the top cap 55 prevents surface water from infiltrating the tank 23.

The top cap 55 covers the central opening 64 defined by the reducer ring 52, thereby preventing access to the interior of the tank 23 while the top cap 55 is in place. However, the top cap 55 is removable for accessing the interior of the tank 23 (e.g., for maintenance). To access the tank interior, a cut is made around the perimeter of the upright wall 76 of the top cap 55 to loosen the top cap 55 from immediately adjacent ground 96 (FIG. 1). Then the bolts are removed. The top cap 55 may then be lifted from the ground, exposing the central opening 64. Sod 99 in the top cap 55 remains intact, facilitating the restoration of a homeowner's lawn when the top cap 55 is replaced above the reducer ring 52 and connected thereto.

The reducer ring 52 essentially reduces the diameter of the top cap 55 required to cover the tank 23, thereby making the removal of the top cap 55 easier than if the top cap 55 were equal to the entire diameter of the tank top portion 40. The reduction of the diameter of the top cap 55 being particularly significant when the top cap 55 is filled with heavy soil. The cross-sectional shapes of the top cap upright wall 76 and the reducer sleeve 61, in cross-sections taken in planes transverse to the longitudinal axes of the respective top cap upright wall 76 and reducer sleeve 61 are depicted as circular in FIGS. 1–6. However, the cross-sectional shapes of the top cap upright wall 76 and reducer sleeve 61 may be any other suitable shape, such as a square or an ellipse.

The tank 23 may have a flange 102 (FIG. 2) near the tank bottom to act as an antifloatation ring to anchor the tank 23 at a predetermined level in the ground when cement is poured over the flange 102.

The bottom of the tank should be about 18 inches below the invert or lowest portion of the cross-section of the sewer line pipe 29. The ejector pump 33 (FIG. 1), which is typically about 13–14" high, is therefore typically about 4 inches below the invert. A suitable sewage ejector pump 33 is a 2" pipe discharge, and ½ horsepower.

The gravity flow pump bypass 43 (FIG. 1) allows overflow to flow to the city sewer line and is activated by the force of gravity. The gravity flow pump bypass 43 comprises a pipe 105 having an inlet 108 disposed in the tank 23, the inlet 108 being positioned higher than the sewer inlet 29, higher than the pump 33, and at a level lower than the basement floor of a home to which the lift station 20 is associated. The pipe 105 may be, for example, 2" brass pipe. The pipe 105 is in fluid communication with the pipe 38. A one-way valve 111 at the junction of the tank 23 and the pipe 105 prevents sewage from flowing into the tank 23. However, if the sewer backs up and the one-way valve 111 is stuck in an open position, the gravity flow pipe 105 will allow sewage into the tank 23. During maintenance, the condition of the one-way valve 111 should be checked to prevent such an occurrence.

Figure 7:
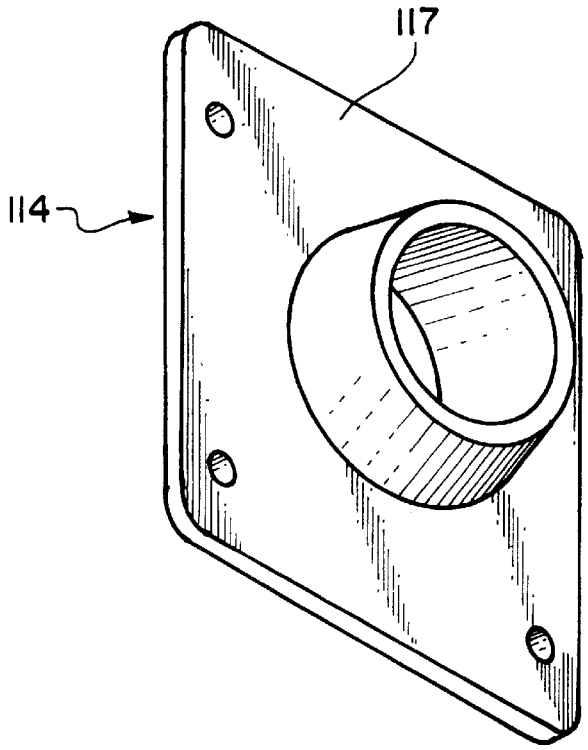
FIG. 7 is a perspective of a threaded coupling.

The pump discharge line 35 and an outlet 112 of the gravity flow pump bypass 43 may each comprise a pair of 2" threaded stainless steel couplings 114 (FIG. 7) having flanges 117, one of the pair of couplings 114 being bolted to the exterior of the tank wall with a gasket (not shown) between the tank wall and the coupling flange 117, and the other of the pair of couplings 114 being bolted to the exterior of the tank wall with a gasket (not shown) between the tank wall and the coupling flange 117. The pipes and fittings connected to the couplings 114 in the interior of the tank 23 may comprise copper sweat pipe. The pipes are threadably fastened to the threaded stainless steel couplings 114 in the interior of the tank 23 and then the copper pipes may be adapted to the couplings 114 for extra strength.

On the outside of the tank 23, each stainless steel coupling 114 is connected to a respective 2" brass nipple (not shown) and the other ends of the respective nipples are connected to a 4"×2" tapped tee (not shown) that connects into a second 4"×2" tapped tee that is connected to a cast iron pipe 120. The 4"×2" tapped tee can be replaced by 4" SDR PVC tees. Also a 4" SDR PVC pipe can be used in place of the cast iron pipe 120.

Figure 12:
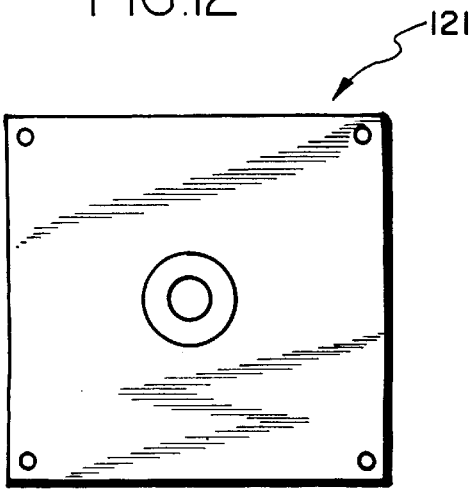
FIG. 12 is a side elevational view of a discharge fitting in accordance with the present invention.
Figure 13:
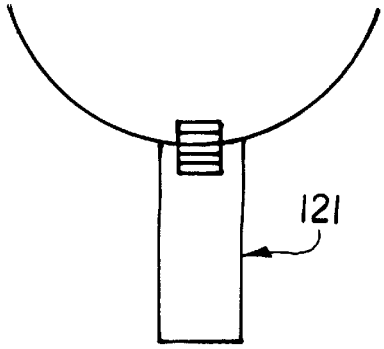
FIG. 13 is a plan view of the discharge fitting of FIG. 12.

In place of the stainless steel couplings 114, a 4"×2" fiberglass discharge fitting 121 (FIGS. 12 and 13) may be used.

The sewer lift station 20 may include a mercury float 123 (FIG. 1) which is part of a high water indicator system. The mercury float 123 operates by having a mercury-filled float which, when the water level rises to a particular height, floats upwardly and completes a circuit. A warning system (not shown) including a bell and a red light is placed in the basement of an associated home to indicate when the circuit is completed (i.e., when the level of water inside of the tank 23 is above the level necessary to actuate the pump 33). When the bell and light are activated, a homeowner becomes informed that there is a problem with the lift station 20. For example, if the pump 33 cannot be easily reactivated, the homeowner will be aware that the gravity flow pump bypass 43 will be operating to remove sewer water. At that point, homeowners could seek service.

Figure 8:
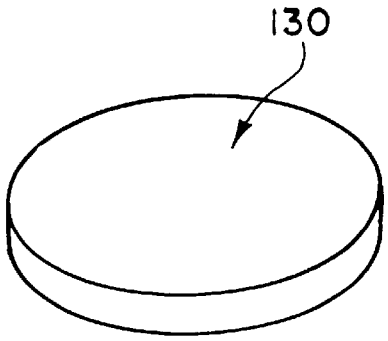
FIG. 8 is a perspective of an alternative embodiment of a top cap in accordance with the present invention.

If the lift station 20 is to be located under a hard surface such as a sidewalk or a driveway, an alternative top cap, top cap 130, shown in FIG. 8, may be used. The alternative top cap 130 does not have the recess 83, but rather is a plate of substantially uniform thickness. The top cap 130 may be removably fastened to the reducer ring 52 in a fashion similar to the top cap 55 of FIGS. 1–6.

Figure 9:
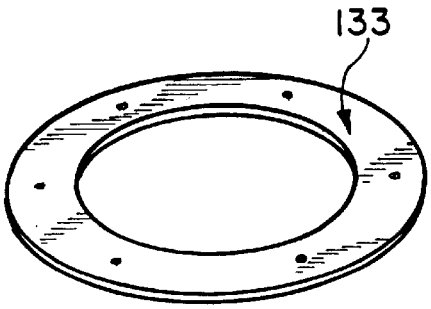
FIG. 9 is a perspective of an alternative embodiment of a reducer ring in accordance with the present invention.

In a further alternative embodiment shown in FIG. 9, a lift station similar to the lift station 20 comprises a reducer ring 133 that does not have the sleeve 61. The reducer ring 133 has an inner diameter smaller than the inner diameter of the top cap 55 and can engage fasteners in a fashion similar to the recessed inner ledge 67 of the reducer ring 52 of FIGS. 1–6.

Figure 14:
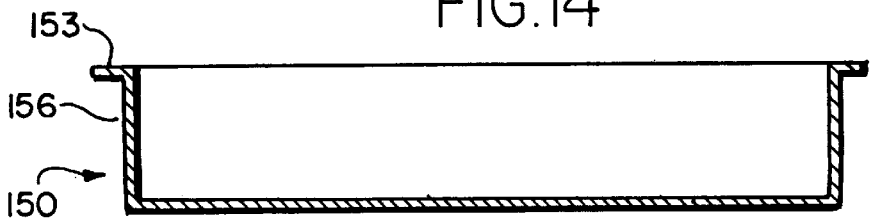
FIG. 14 is a sectional, side elevational view of a further alternative embodiment of a top cap.

An alternative top cap embodiment, a top cap 150, is shown in FIG. 14 and is similar to the top cap 55 but comprises a flange 153 that extends radially outwardly from a wall 156. The flange 153 facilitates lifting of the top cap 150 during removal from the ground.

Figure 15:
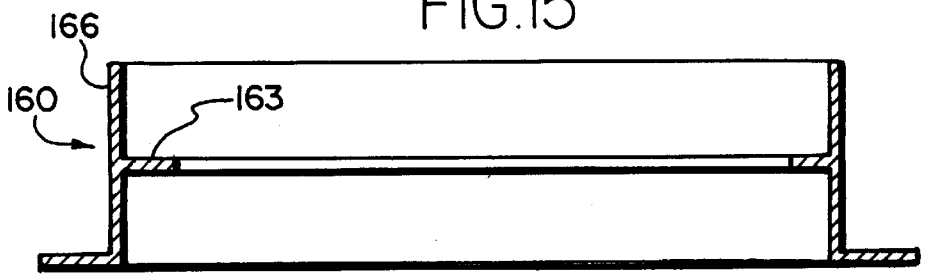
FIG. 15 is a sectional, side elevational view of a further alternative embodiment of a reducer ring.

FIG. 15 illustrates a reducer ring 160. The reducer ring 160 is similar to the reducer ring 52 but has a flange 163 extending inwardly from an interior surface of a sleeve 166. The flange 163, an internal sealing flange, forms a seal against the bottom of a top cap when the top cap is in place. The reducer ring 160 can be used with the top cap 55, the top cap 150 (FIG. 14), or similar designs. Because the flange 163 vertically supports the top cap 55 or the top cap 150, the top cap can engage the reducer ring 160 by a slip fit, without the use of bolts. Also, when the top cap 150 is used with the reducer ring 160, the flange 153 rests against an end of the sleeve 166, thereby providing vertical support for the top cap 150.

Figure 16:
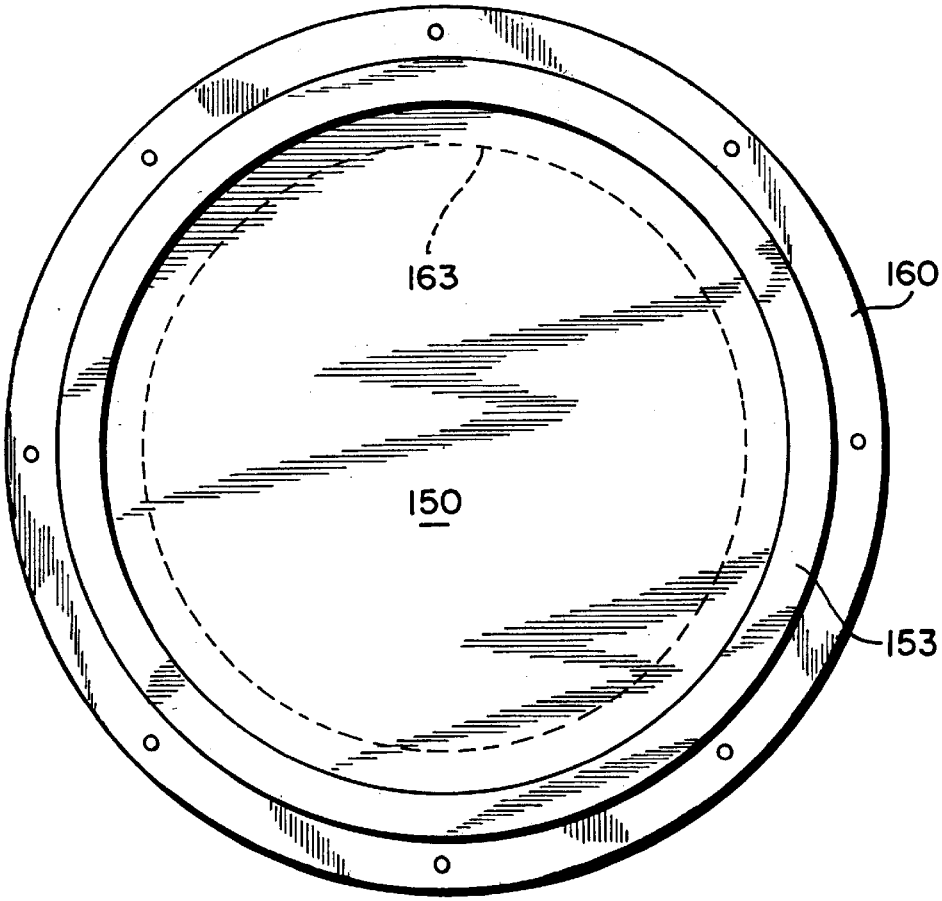
FIG. 16 is a plan view of a lawn trim ring set having the top cap of FIG. 14 and the reducer ring of FIG. 15.

FIG. 16 depicts a plan view of a lawn trim ring set in which the top cap 150 is engaged to the reducer ring 160. Lawn trim ring sets comprising one or both of the top cap 150 and the reducer ring 160 can be used in lift stations similar to the lift station 20.

The foregoing detailed description has been given for clearness of understanding only, and no unnecessary limitations should be understood therefrom, as modifications will be obvious to those skilled in the art.

What is claimed is:

1. In a sewage lift station including a tank locatable in a user's lawn for holding sewage to be pumped out of the tank, the tank including a tank flange at the top portion thereof, the improvement of a lawn trim ring for the tank top portion comprising:

a top cap having a bottom plate and a wall extending upwardly therefrom, said top cap including holes for drainage; and a reducer ring including a ring flange for sealing to the tank flange at the tank top portion and a sleeve extending upwardly from the ring flange, wherein the sleeve defines a central opening and is removably attached to the top cap.

2. The sewage lift station improvement of claim 1 wherein:

the top cap is bolted the reducer ring.

3. The sewage lift station improvement of claim 1 wherein:

the top cap is attached to an interior surface of the reducer ring sleeve by a slip fit.

4. The sewage lift station improvement of claim 1 wherein:

the reducer ring includes an internal sealing flange extending inwardly from an interior surface of the sleeve for sealing the reducer ring to the top cap.

5. The sewage lift station improvement of claim 1 wherein:

the top cap includes a cap flange extending radially outwardly from a top portion of the wall.

6. A sewage lift station comprising:

a tank having a top portion, the tank locatable in a user's lawn for holding sewage to be pumped out of the tank;

a sewer line inlet in fluid communication with the tank;

an ejector pump disposed in the tank;

a pump discharge line extending upwardly from the pump and attached to an outlet adjacent the tank top portion, said outlet for connection to a sewer line;

a gravity flow pump bypass disposed in the tank including a pipe having an inlet disposed in the tank, wherein the pipe inlet is positioned higher than the sewer line inlet and higher than the pump;

said pump discharge line and said pipe in fluid communication with the sewer line;

a one-way valve disposed in the pipe, the one-way valve preventing sewage from flowing into the tank from the pipe; and a lawn trim ring mountable on the tank top portion, including, a top cap having a bottom plate and a wall extending upwardly therefrom, said top cap including holes for drainage; and a reducer ring comprising a flange for sealing to the tank top portion and a sleeve extending upwardly from the flange, wherein the sleeve defines a central opening and is removably attached to the top cap.

7. The sewage lift station of claim 7 wherein:

the top cap is bolted the reducer ring.

8. The sewage lift station of claim 6 wherein:

the top cap is attached to an interior surface of the reducer ring sleeve by a slip fit.

9. The sewage lift station of claim 6 wherein:

the reducer ring includes an internal sealing flange extending inwardly from an interior surface of the sleeve the reducer ring to the top cap.

10. The sewage lift station of claim 6 wherein:

the top cap includes a flange extending radially outwardly from a top portion of the wall.

* * * * *